United States Patent [19]

Keskiivari et al.

[11] Patent Number: 5,074,965

[45] Date of Patent: Dec. 24, 1991

[54] SINGLE-LAYER OR MULTI-LAYER HEADBOX FOR WIDE FLOW RANGE WITH ADJUSTABLE BYPASS FLOW GUIDE

[75] Inventors: Juha Keskiivari; Tapani Nyman; Tapio Waris, all of Karhula, Finland

[73] Assignee: Valmet-Karhula Inc., Finland

[21] Appl. No.: 633,980

[22] Filed: Dec. 26, 1990

[30] Foreign Application Priority Data

Dec. 22, 1989 [FI] Finland ..... 896203

[51] Int. Cl.[5] ..... D21F 1/06

[52] U.S. Cl. ..... 162/216; 162/337; 162/343; 162/341

[58] Field of Search ..... 162/216, 212, 336, 337, 162/341, 343, 338

[56] References Cited

U.S. PATENT DOCUMENTS

| | | | |
|---|---|---|---|
| 3,802,960 | 4/1974 | Spengos et al. | 162/216 |
| 3,837,999 | 9/1974 | Chung | 162/101 |
| 3,843,470 | 10/1974 | Betley et al. | 162/344 |
| 3,972,771 | 8/1976 | Notbohm | 162/343 |
| 4,021,295 | 5/1977 | Schmaeng | 162/343 |
| 4,133,715 | 1/1979 | Hergert | 162/341 |
| 4,162,189 | 7/1979 | Kirjavainen | 162/337 |
| 4,181,568 | 1/1980 | Pfaler | 162/343 |
| 4,285,767 | 8/1981 | Page | 162/216 |
| 4,361,467 | 11/1982 | Bubik et al. | 162/336 |
| 4,604,164 | 8/1986 | Fujiwara et al. | 162/343 |
| 4,804,441 | 2/1989 | Lyytinen | 162/336 |
| 4,880,094 | 12/1989 | Weisshuhn et al. | 162/343 |

FOREIGN PATENT DOCUMENTS

| | | | |
|---|---|---|---|
| 3439051A1 | 3/1986 | Fed. Rep. of Germany . | |
| 37030775A1 | 3/1988 | Fed. Rep. of Germany . | |
| 73765 | 7/1987 | Finland . | |
| 996585 | 2/1983 | U.S.S.R. | 162/336 |

*Primary Examiner*—Karen M. Hastings
*Attorney, Agent, or Firm*—Nixon & Vanderhye

[57] ABSTRACT

A single- or a multi-layer headbox of a paper or a board machine intended for consistencies of 0.7–2.2% and provided with a flow ratio adjustment device. The adjustment device operates by removing a part of the stock flow from the slice chamber out of the headbox in a manner that does not change the speed or turbulence of the flow going to the slice at any point of the headbox.

19 Claims, 3 Drawing Sheets

SINGLE-LAYER OR MULTI-LAYER HEADBOX FOR WIDE FLOW RANGE WITH ADJUSTABLE BYPASS FLOW GUIDE

BACKGROUND AND SUMMARY OF THE INVENTION

The present invention relates to an apparatus positioned in the headbox of a paper or board machine which apparatus enables the selection of the headbox running parametres from a considerably wider range when running stock consistencies of 0.7–2.2%. To be more precise, the invention relates to an apparatus which allows the adjustment of the headbox slice flow volume at the same time keeping the important geometric dimensions of the flow channel to the slice within tolerances that allow the desired turbulence and the evenness of the flow in the cross direction of the machine to remain substantially as they were regardless of the adjustment. In addition, the manifold can be divided into different sections so that the stocks discharging out from the slice constitute a multi-ply web.

The present invention also relates to a method for producing either a single-ply or a multi-ply web by running the headbox at different flow speeds of the channels 3 which change the pattern of the total turbulence in the slice channel 8. This pattern can also be influenced by choosing different lengths and shapes for the partition walls 3*a*.

The headbox adjustability is known to be problematic with such paper machines that are not used for running the so called bulk grades, but whose products have to be changed relatively frequently. The function of the headbox is to spray the stock onto the wire. When coming out from the headbox, the stock moves at the same speed as the wire. The thickness of the fibre layer that stays on the wire is determined by the stock consistency and the size of the slice opening provided that the wire speed remains constant. In case the wire speed is changed, the speed of the stock being discharged form the headbox can be changed by adjusting the internal hydraulic pressure in the headbox. In the end, the hydraulic pressure is determined by a feed pump. Thus the production/pressure characteristics of the feed pump set the absolute limits for the headbox adjustability.

There are some other restrictions, too. The stock will have to flow in a manner that it stays in a turbulent state, a fact that prevents the formation of fibre bundles. This requirement is met differently in a rectifier roll headbox and a hydraulic headbox. A rectifier roll headbox is adjustable within a wider flow range than a hydraulic headbox. There are, however, several reasons, for example the use of stock mixtures of higher consistency than normal or high running speeds, that speak for a hydraulic headbox. A hydraulic headbox is sensitive to turbulence disturbances. That is why it requires a flow speed within a certain narrow range in the pipes of the turbulence generator. If this requirement is not met, the web coming onto the wire does not have a formation good enough and is not of adequate quality.

In the prior art solutions, the flow rate adjustment has been carried out by two different principles in addition to the feed pump. In one, a part of the cross section of the flow is reduced at some point of the headbox. Another method is to arrange a by-pass flow at some point before the slice opening which directs a part of the stock flow to recycling, thus reducing the slice flow. In addition, in some of these prior art solutions, the headbox dimensions are adjusted so that the slice chamber cross section is reduced if the flow has been reduced at some point earlier. This indicates that it has been considered necessary to maintain a sufficient flow speed and turbulence level in the slice chamber also after the flow has been reduced.

The prior art solutions, however, have shortcomings that the present invention will eliminate. A typical shortcoming is that the realized flow control method changes the flow speeds in the entire headbox. Another defect is that the closing of some channels of the headbox causes danger of clogging and thus the access of fibre bundles onto the wire. The third defect is the arrangement of the by-pass in a manner that the pattern of turbulence in the slice chamber undergoes a fundamental change. The fourth defect comparable with the latter one is that the reduced flow volume is directed into a slice chamber with unchanged dimensions where the turbulence is spoiled by the reduced flow speed. A fifth defect is the impractical mechanical solution for the adjustments.

The present invention solves all the five shortcomings and, moreover, also gives an opportunity to use the same headbox for the production of a multi-ply web.

A rectifier roll headbox (for example U.S. Pat. No. 3,972,771) is the oldest of the headbox constructions discussed here. It is applicable to the handling of conventional consistencies of 0.1–1.0%. This type of headbox cannot be applied to higher consistencies without difficulties. On the other hand, it has a large adjustability range of flow-through rates; that is, the relation between its highest and lowest possible flow-through volume is relatively big, perhaps S=2.5 (S refers to the relation of the highest possible flow-through volume to the lowest possible and the word "possible" refers to the limit beyond which the web qualities fail to meet the quality or runnability requirements. The headbox is named after the hollow roll or rolls (66) equipped with a perforated shell slowly rotating inside the headbox mixing the stock before it flows to the slice opening.

A hydraulic headbox (for example U.S. Pat. No. 4,133,715) has no rectifier roll to mix the stock and water evenly and to dampen the cross-machine macroflows but uses a so called turbulence generator to carry out the above mentioned functions. Usually, this turbulence generator consists of a tight bunch of rather short pipes whose diameter grows steppedly in the flow direction. The pipes can also be tapered so that their cross-sections grow from the beginning to the end. The cross-cut of the pipes can either round or polygonal, usually rectangular. This type of headbox handles stock consistencies of 0.1–1.0% as the rectifier roll headbox, but its flow ratio is smaller.

A high-consistency headbox (U.S. Pat. No. 4,021,296 and U.S. Pat. No. 4,285,767) is a special type of a hydraulic headbox. As to the process, it is different from a hydraulic headbox in that due to the low stock flow rate it would be impossible to mix the stock with a rectifier roll. Also, a turbulence generator of tubular construction would be insufficient. In order to avoid headbox blockage, the stock has to be kept in internal motion as it flows through the headbox. For this purpose, a wavy slice chamber or a slice chamber with stepped curves have been found out to be the best solutions. At the end of the slice chamber, the stock sets to a ready formatted web that is discharged from the slice opening onto the wire. At this stage, the fibres cannot move in relation to one another; only water can be removed from between the fibres. The typical consistency range of a high-consistency headbox is 2–6%. Instead of referring to it as a "headbox" it could well be called a "web extruder", a name yet not in use.

Mainly for the manufacture of board, an open range has been left between the above mentioned headboxes for stock consistencies of about 0.7–2.2%. For the manufacture of board, it would be economical to use these consistencies but both the rectifier roll headbox and the hydraulic headbox have to operate at the extreme limits of their adjustment range when running this kind of stock which results in poor headbox adjustability and/or runnability.

Here, the headbox adjustability refers to the adjustment of flow ratio (S) which can be presented in a formula:

$$S = Qmax/Qmin$$

in which

S = flow ratio

Qmax = the highest flow-through volume applicable to a headbox which gives an acceptable web quality and sufficient runnability Qmin = the lowest flow-through volume on corresponding conditions In a rectifier roll headbox, the flow ratio (S) is approximately 2.5. The weak point of a hydraulic headbox is a smaller control range; its flow ratio (S) varies between 1.5–2.0 depending on the conditions.

The objective of the present invention is to develop a headbox applicable to medium consistencies of 0.7–2.2% with a good adjustability as to the flow ratio in particular.

The flow ratio is restricted by the turbulence state of the stock-water mixture. The turbulence state will have to meet certain requirements to enable the stock discharging from the slice in order to form a well formatted web of an even quality. In a hydraulic headbox, a certain minimum flow rate has to be maintained to enable the turbulence generator with no moving parts to reach the desired level of turbulence. On the other hand, should a certain maximum flow rate be exceeded, too much turbulence is created in the headbox, a fact that impairs the quality of the web being discharged from the slice. These extreme limits are diffuse to some extent yet being so clear that their existence is generally known.

The prior art solutions to be discussed in the following indicate a clear difference between a rectifier roll headbox (U.S. Pat. No. 3,972,771), a hydraulic headbox (U.S. Pat. No. 4,133,715) and a high-consistency headbox (U.S. Pat. No. 4,021,296). Of these the two first mentioned types of headbox have been provided with additional features the purpose of which have been to adjust the flow ratio of the headbox in question or, in some cases, only to add/remove stock or water from the slice chamber in order to correct the local defects in the slice flow to achieve a better product.

U.S. Pat. No. 4,133,715 discloses a hydraulic headbox comprising a turbulence generator of tubular construction and a slice chamber forming an angle of about 75° with it. The upper wall of the slice chamber is pivoted to the upper edge of the turbulence generator. The upper wall can be adjusted around the pivoting point in question thus increasing or decreasing the height of the slice chamber, most near the slice opening. As a result of this adjustment, the height of the slice chamber slightly changes while the manifold discharge area feeding stock into the slice chamber remains constant. There is no adjustment device for this. No stock is removed from the slice flow but all stock that was fed into the headbox flows out through the slice. This kind of headbox can operate with a flow ratio of S=2.0 at the highest producing a poor quality web close to the maximum and minimum flow settings. The runnability suffers at the same time. This example is a basic solution of a headbox without a flow adjustment device.

U.S. Pat. No. 3,972,771 discloses a rectifier roll headbox provided with a turbulence generator and a slice chamber positioned in line. The height of this slice chamber can be adjusted both by the method described in the above reference and, in addition, by vertically moving the pivoting point of the slice chamber upper wall. The vertical transfer of the pivoting point downwards causes the upper turbulence generator openings to be closed or, in other words, the number of the active turbulence generator pipes decreases. When the flow rate is reduced in the slice chamber, and therefore also in the turbulence generator, it is also reduced in all other parts of the headbox. The flow rate may be reduced to such an extent that it may go below the operating range of, for example, the header.

DE 3439051 discloses a principle solution for a hydraulic headbox (FIG. 7) in which a small amount of the stock flowed into the slice chamber (61) is let out back to the recycling through a hatch (59) instead of letting it flow to the slice opening, and thus the flow rate of the slice opening is decreased although the flow rate of the turbulence generator is kept at a high level in order to achieve a good turbulence. Another stock discharge opening is the slide (58). The opening of the slide naturally decreases the flow rate of the turbulence generator (54). The objective of the invention is not the adjustment of the flow ratio but a better formation control. This kind of solution, if it were used for discharging an essential amount of the stock flow from the slice flow, does not create a flow stable enough in the slice chamber. This is due to the fact that the dimensions of the slice chamber do not change as the function of the bypass setting. Moreover, the separation point of the flow causes detrimental whirls in the flow running to the slice opening.

U.S. Pat. No. 4,162,189 discloses a headbox where the upper wall of the slice chamber (20*a*) can be raised or lowered utilizing a guideway (21) (FIG. 1). It is also possible to discharge stock here by letting some stock to flow over the thresold (26*a*) into the discharge pipe (27). The objective of this arrangement, however, is to keep the stock level (S) constant and not to act as a slice flow reducer. This kind of overflow structure can be found in numerous headboxes. The area of the turbulence generator (15) is unadjustable. The surface level of stock (S) is determined by the thresold (26*a*). The slice chamber height adjustment is here only a way to adjust the slice opening.

In U.S. Pat. No. 3,837,999 the slice chamber cross section can be seen in FIGS. 3, 4, 6, and 7. The dimensions of the slice chamber in FIG. 3 can be altered by installing a solid item (44) inside the slice chamber. Presumably, there is no turbulence generator in this headbox. The adjustment method is so troublesome that it is not considered viable in the paper making art. The chief aim is the adjustment of the slice opening which becomes evident in FIGS. 6 and 7.

In some solutions like U.S. Pat. No. 4,604,164 and U.S. Pat. No. 3,843,470, the slice chamber is divided into several channels on top of one another with sheets mainly to avoid macroturbulence so that there would be a microturbulence in each separate channel. The dimensions of the channels are not actually adjusted the strict positions of the dividing walls being determined by the pressure in each channel. The discharge surface of the manifold is not adjusted, either. In these publications, the adjustment of the flow ratio is not carried out by changing the area of the flow or by removing stock on the way.

U.S. Pat. No. 3,802,960 discloses a headbox producing a single- or multi-layer web. item (20) can be regarded as a turbulence generator and item (23) as a slice chamber. A movable wedge (29) can be positioned inside the turbulence generator. The cross-sectional area of the turbulence generator (20) as well as that of the slice chamber (23) can be changed with this wedge. However, a rather big flow change is achieved with a small move of the wedge, and the state of the stock turbulence changes in a way that is difficult to predict. No by-pass is used. The workshop manufacture of the device is relatively difficult. Even small defects in the dimensions cause considerable changes in the flow pattern. The objective of the invention is not the flow ratio adjustment but turbulence control and improved quality of the slice flow. The apparatus is unsuitable for high (over 1.5%) stock consistencies since, after the turbulence generator (20), the stock flow towards the slice is more or less laminar, i.e. the changes in direction and speed are minimal. Turbulence can be achieved with very high stock speeds only. If the speeds are reduced, the risk of floc forming is very high. Nor is the support method of the wedge suitable for wide machines due to the wedge deflection. The wedge bends in the middle and vibrates squeezing the headbox mainly in the middle part. The changes in speed and consistency are difficult to control.

U.S. Pat. No. 4,285,767, like the above, describes the adjustment of a slice chamber with the help of an internal wedge. The area of the discharge surface feeding the slice chamber of the turbulence generator (22,23) remains constant in this invention, too. No by-pass is used.

Fl Application No. 853293 presents a very similar kind of solution to U.S. Pat. No. 3,972,771 this time applied to a hydraulic headbox. In FIGS. 1 and 2, the uppermost rows of the manifold pipes of the turbulence generator, or, in FIGS. 3 and 4, the lowest rows of the manifold pipes can be covered by a slide (10*a*), and the pivoted top wall (8) of the slice chamber changes the dimensions of the slice chamber. In this application, no by-pass is used. That is why at points (20, 21 and 3) the flow speeds change as a result of the adjustment.

The present invention combines the following features in the same headbox construction:

1. The headbox is suitable for handling stocks at consistencies of 0.7–2.2% which is why it is equipped with a turbulence generator. In the channels of the turbulence generator, the stock flow undergoes steep changes in the flow direction or the cross-section of the flow.

2. A change in the headbox flow ratio (S), irrespective of the change in the flow rate, keeps the flow conditions constant in all parts of the headbox from the feed pipe up to the slice with the exception of the slice flow volume.

3. The headbox can also be designed as a multi-layer headbox in which case the adjustment described in Point 2 applies to the flow of at least one stock layer.

4. The headbox is furnished with an internal cleaning system which prevents the stock from sticking to those parts of the adjustment system that are not flushed by the constant stock flow.

BRIEF DESCRIPTION OF THE DRAWINGS

FIG. 1 discloses a header 1 which directs the stock into the manifold 2*a* with three rows of holes 2 in the solution presented in the Figure. Via the holes, the stock flows through the manifold 2*a*. The header 1 can be divided into separate headers with one or more partition walls 1*b*. In this case it is possible to produce a multi-ply web with the headbox. In the solution of FIG. 1, the bottommost channel 3 between the partition walls conveys a separate stock from that flowing in the two upper channels between the partition walls. As to the by-pass, in this solution the flow rate adjustment applies to the two uppermost channels only. The partition walls 1*b* can be positioned at the most suitable points for the product. The stock comes into the channels 3 between the stepped partition walls 3*a* extending across the machine. In this solution, the stock flow in the three separate channels reaches the desired turbulence thanks to the stepped shape of the channels. From the channels, the stock flows into the slice chamber 8. Below, the slice chamber is bounded by a fixed wall 6*a* and above by a pivoted movable wall 6 whose pivoting point 7 is positioned on the vertically movable flow guide 4. The wall 6 is turned around the pivoting point 7 by means of an adjustment device 10. Having passed the slice chamber 8, the stock is discharged onto the wire of the paper machine (not shown) through the slice opening 9. The pivoting point 7 can be replaced with a rigid mounting which enables the vertical bending of the item 6 at the slice opening 9 utilizing the elasticity of the material. The dividing walls 3*a* are rigidly fixed at the manifold end but they are interchangeable to, for example, plates of a different shape.

The length of the dividing plates varies and they are not necesarily of the same length.

Figure 2:
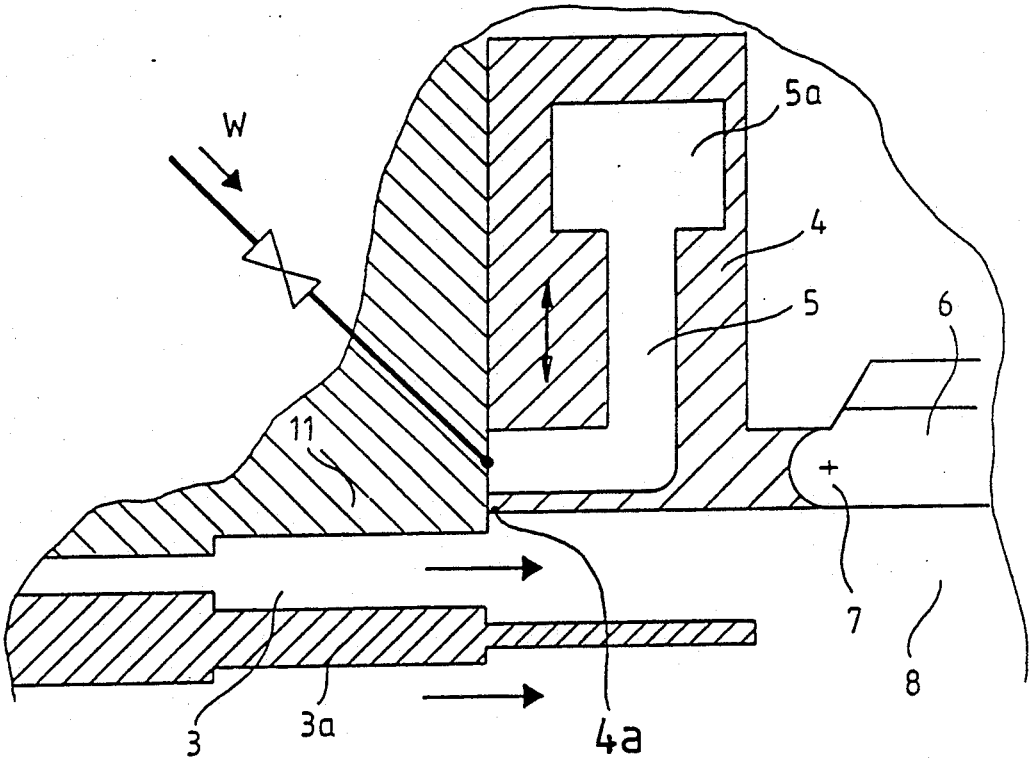
FIG. 2 is a partial enlargement of the section illustrated in FIG. 1, showing a flow guide in an uppermost position.

To the frame body 11, a sliding surface is attached along which the flow guide 4 can be moved in the vertical direction. The flow guide 4 has two extreme positions; far up, as in FIG. 2, or far down as in FIGS. 3 and 4. It is also possible to adjust the flow guide between these extreme limits (not shown) and then the by-pass operates partially. The height of the opening of the channel 5 in the flow guide may be variable in the direction of breadth of the headbox. This can be used to influence, for example in the edge areas of the headbox, the division of the stock flow between the slice and the by-pass in a different proportion than in the middle of the headbox. This feature can be utilized in the levelling of the orientation and grammage profiles in the direction of breadth of the web.

The amount of stock flowing into the channel 5 is variable at the different points of the headbox width also by dividing the channel 5 into chambers in the direction of breadth of the headbox and by ejecting the stock from the chambers with different vacuums.

When the flow guide 4 is at its top position, the headbox operates at its highest possible flow rate utilizing the entire discharge surface of the turbulence generator 3.

Figure 3:
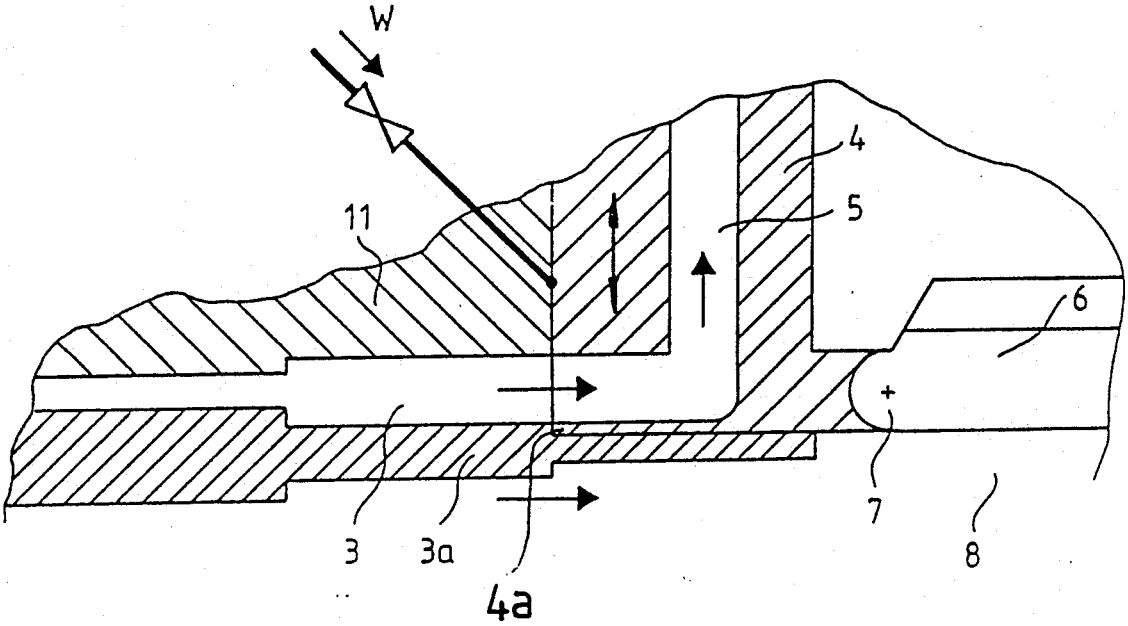
FIG. 3 is a partial section of the headbox portion in FIG. 2 with the flow guide in a lowermost position.
Figure 4:
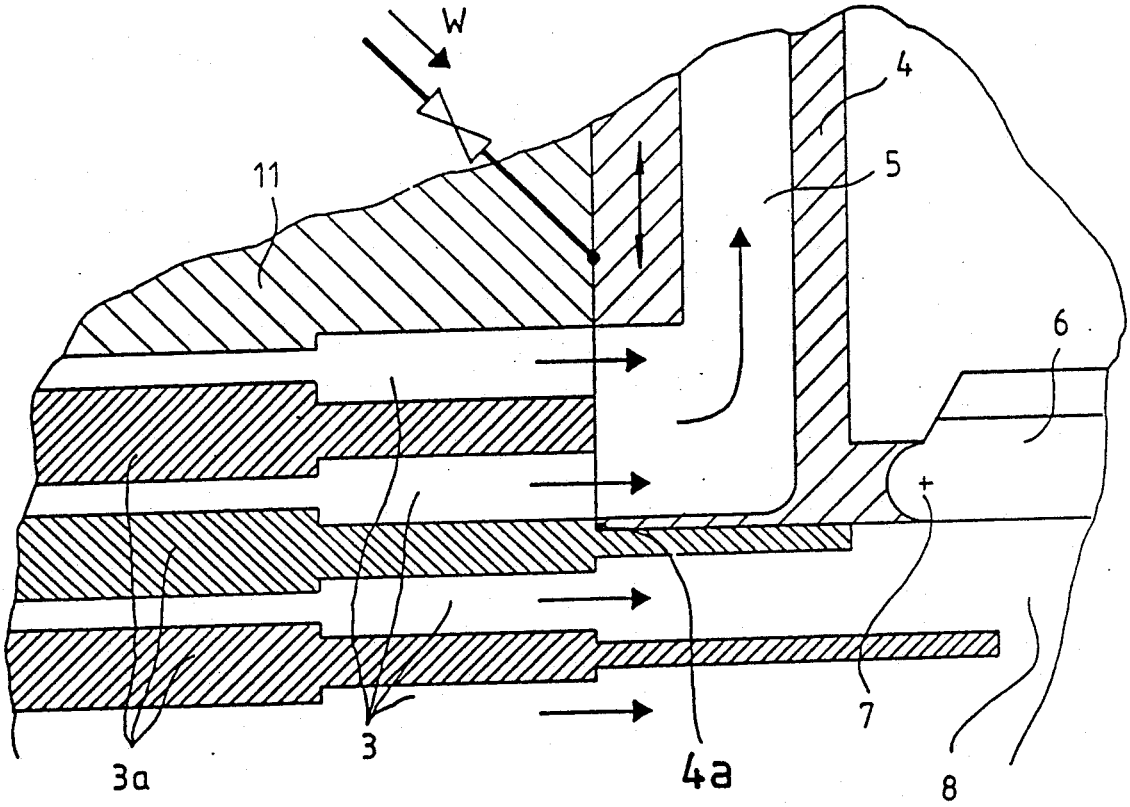
FIG. 4 is a partial section of an alternate embodiment of the headbox in accordance with the invention.

When the flow guide 4 is adjusted to its bottom position in FIG. 3, the channel 5 inside the flow guide 4 moves to the uppermost one of the three horizontal flow channels thus sealing the slit between the dividing wall 3*a* and the bottom edge 4*a* of the flow guide 4. The entire flow in the uppermost channel is directed through the channel 5 to the discharge opening 5*a* and that way back to recycling. The flow guide 4 can also be designed so that the stocks from more than one channel are discharged according to the same principle into the channel 5 (FIG. 4). When the flow guide 4 is at the top position (FIG. 2), its channels 5 and 5*a* can be flushed with fresh water W in order to prevent the formation of fiber bundles.

Figure 1:
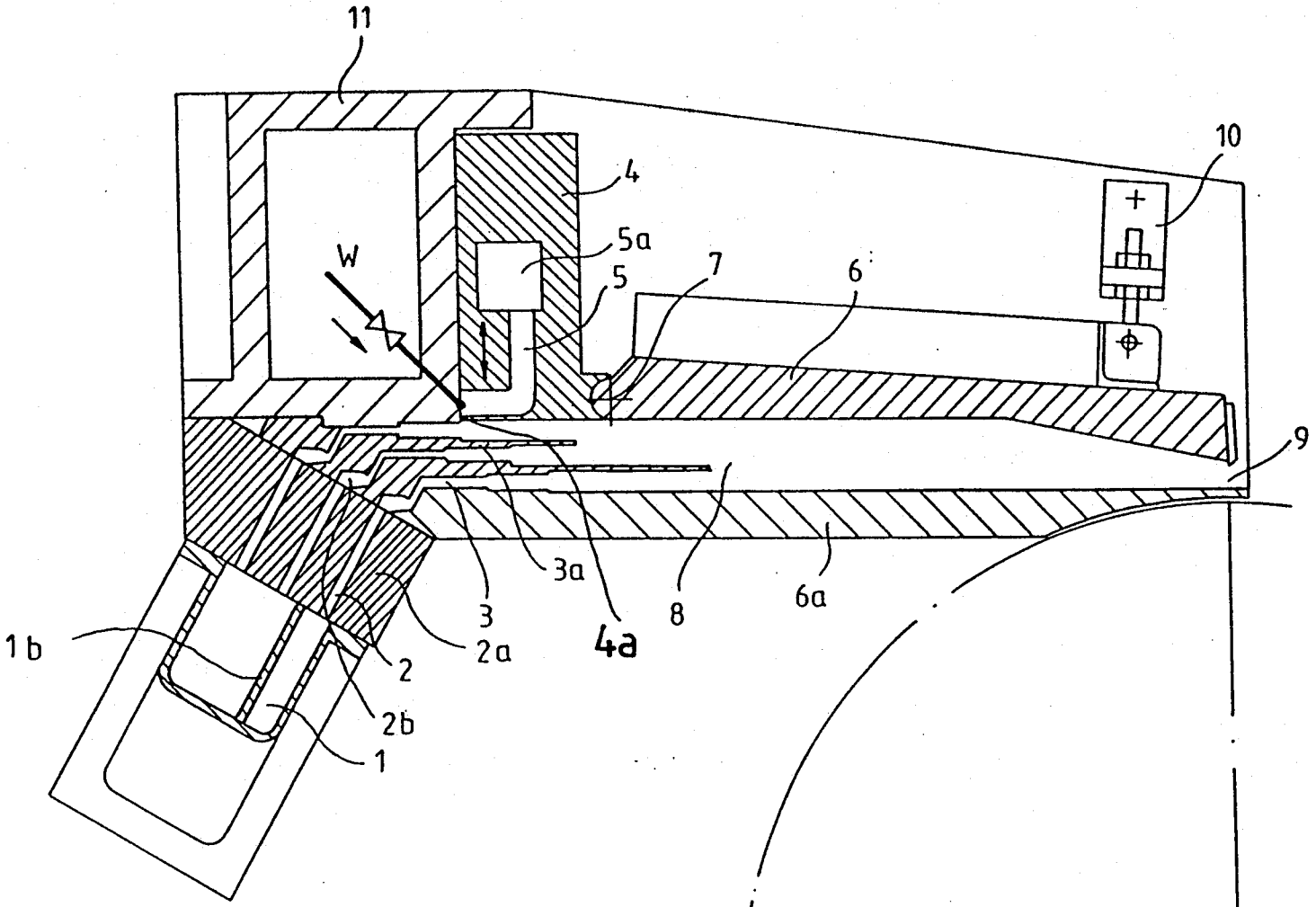
FIG. 1 is a cross section of a headbox in accordance with the invention.

If the flow guide 4 in FIG. 1 is at the bottom position (see FIG. 3), only the two bottommost channels discharge stock to the slice. However, at the same time the upper wall 6 of the slice chamber has descended thus decreasing the cross area of the slice chamber 8 and forcing the stock to a flow speed sufficient for the turbulence. The slice opening 9 is adjusted to a suitable size with a separate device 10. As to the flow in the channels 3, the movement of the flow guide 4 can be at an angle of 15°–165° in relation to the flow direction. The angle in the Figures is 90°. In this solution with three horizontal turbulence channels, the lowering of the flow guide 4 makes the headbox flow rate one third lower at the slice. The channel 5*a* leads the by-pass flow out of the headbox preferably through the sides of the headbox but other exit directions are also possible.

Taking into account the natural adjustment allowance of the headbox in the flow-through—$S_1=1.6$—the following limiting values are derived for the total adjustment. (The natural adjustment allowance is assumed to be relatively small due to the rather consistent stock.)

Flow guide 4 at the top position: (flow per meter of the headbox width)

$$\text{maximum flow } 5000(1/\text{min}\times m)=5000=Q_1$$

$$\text{minimum flow } 5000/1.6(1/\text{min}\times m)=3125=Q_2$$

Flow guide 4 at the bottom position:

$$\text{maximum flow } 2\times 5000/3(1/\text{min}\times m)=3333=Q_3$$

$$\text{minimum flow } 2\times 5000/3\times 1.6(1/\text{min}\times m)=2080=Q_4$$

From this follows that the adjustment range for the flow ratio (S) when using the flow guide 4 is $$S=Q_1/Q_4=5000/2080=2.4$$

when without the flow guide 4 it would have been $$S=Q_1/Q_2=5000/3125=1.6$$

In case of a headbox provided with a partition wall 1*b* presented in FIG. 1, the adjustment of the flow ratio by means of the by-pass concerns the stocks flowing through the two uppermost channels only. Since half of the flow can be directed back to recycling, the value of the flow ratio of this stock grade is bigger than the figure above.

In addition to a headbox with three turbulence channels, the present invention is also applicable to headboxes with fewer or more channels. Moreover, the construction in which the manifold forms an angle of 60° with the slice chamber presented in the Figure is not the only alternative but the angle can be anything between 0° and 180°. The channels of the turbulence generator can be replaced with pipes. However, when using pipes, the stock consistency cannot substantially exceed 1.5%. It is also possible to have both channels and pipes in the same headbox. In a multi-layer headbox, for example, if two separate stocks are used, the other stock can be directed through the channels and the other through pipes.

We claim:

1. A headbox of a paper or board machine comprising a header; a manifold for receiving stock from the header; a slice chamber including a slice opening; at least one channel for supplying stock from said manifold to said slice chamber; and a flow guide and associated adjustment means for moving said flow guide into and out of said at least one channel for adjusting stock flow to said slice chamber by changing dimensions of said channel and by diverting a portion of said stock flow through a bypass channel in said flow guide, said at least one channel provided with means for generating turbulence in said stock during passage through said at least one channel.

2. The headbox according to claim 1 and including at least three channels extending between said manifold and said slice chamber.

3. The headbox according to claim 2 wherein said flow guide is configured to adjust stock flow simultaneously in two of said three channels.

4. The headbox according to claim 2 wherein each of said three channels is provided with means for generating turbulence in said stock during passage through said three channels.

5. The headbox according to claim 2 wherein said flow guide is sized and located relative to said one or more of said three channels to partially or completely divert stock flowing through said one or more of said three channels into said flow guide when bypass channel moved into said one or more of said three channels by said adjustment means.

6. The headbox according to claim 1 wherein said flow guide is sized and located relative to said at least one channel so as to partially or completely divert stock flowing through said at least one channel into said flow guide bypass channel when said flow guide is moved into said at least one channel by said adjustment means.

7. The headbox according to claim 6 wherein said flow guide bypass channel is structured for recycling stock removed from said at least one channel.

8. The headbox according to claim 7, wherein said flow guide is adjustable by said adjustment means to a position away from at least one channel where said bypass channel is in communication with means for cleaning said bypass channel.

9. The headbox according to claim 1 wherein said flow guide is adjustable by said adjustment means at an angle of from 15° to 160° against a flow direction of stock in said at least one channel.

10. The headbox according to claim 1 wherein said header is subdivided by at least one wall to thereby form at least two sources of stock; said manifold being provided with a number of passages equal to said at least two sources of stock; and including at least two channels for supplying stock from said at least two sources into said slice chamber in layered form.

11. The headbox according to claim 2 wherein said channels are separated by partition walls and wherein said flow guide has a bottom wall sealingly engageable with a partition wall of said at least one channel.

12. The headbox according to claim 11 wherein said partition walls extend different lengths into said slice chamber.

13. The headbox according to claim 1 and including means for adjusting said slice opening.

14. The headbox according to claim 1 wherein said slice chamber is formed in part by a wall pivotally mounted to said flow guide.

15. A method for adjusting headbox flow ratio by using a bypass flow upstream of a slice opening in a paper or board machine comprising the steps of:

a) providing at least one channel for supplying stock to a slice chamber incorporating said slice opening;

b) providing turbulence generating means in said at least one channel;

c) locating an adjustable flow guide including a bypass channel downstream of said turbulence generating means and upstream of said slice chamber; and d) adjusting flow of said stock through said at least one channel by moving said adjustable flow guide into said at least one channel to thereby change dimensions of said channel and cause at least a portion of said stock to flow into said bypass channel to thereby divert said portion around said slice chamber.

16. The method of claim 15 wherein a plurality of channels are provided, each having turbulence generating means.

17. The method of claim 16 wherein said plurality of channels supply separate layers of stock to said slice chamber.

18. The method of claim 15 wherein stock flow is distributed to the bypass channel and the slice opening in different proportions along a width dimension of the headbox.

19. The method of claim 15 and including the step of adjusting the slice opening.

* * * * *